US009970087B2

(12) United States Patent
Hashimoto et al.

(10) Patent No.: US 9,970,087 B2
(45) Date of Patent: May 15, 2018

(54) R-T-B BASED PERMANENT MAGNET AND RAW ALLOY FOR THE SAME

(71) Applicant: TDK CORPORATION, Tokyo (JP)

(72) Inventors: Ryuji Hashimoto, Tokyo (JP); Yasushi Enokido, Tokyo (JP); Hironori Wada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 339 days.

(21) Appl. No.: 14/686,200

(22) Filed: Apr. 14, 2015

(65) Prior Publication Data

US 2015/0302959 A1 Oct. 22, 2015

(30) Foreign Application Priority Data

Apr. 21, 2014 (JP) ..... 2014-087382

(51) Int. Cl.
*C22C 38/00* (2006.01)
*H01F 1/057* (2006.01)

(52) U.S. Cl.
CPC ..... *C22C 38/002* (2013.01); *C22C 38/005* (2013.01); *H01F 1/0577* (2013.01); *B22F 2998/10* (2013.01)

(58) Field of Classification Search
CPC ..... H01F 1/0577; B22F 2998/10; B22F 2009/043; B22F 3/02; B22F 3/10; B22F 9/023; B22F 9/04; C22C 38/005
See application file for complete search history.

(56) References Cited

U.S. PATENT DOCUMENTS

| | | | | |
|---|---|---|---|---|
| 4,770,723 | A | 9/1988 | Sagawa et al. | |
| 6,447,621 | B1 * | 9/2002 | Tokoro | H01F 1/0577 148/302 |
| 2002/0144754 | A1 | 10/2002 | Tokoro et al. | |
| 2004/0020563 | A1 * | 2/2004 | Tokuhara | H01F 1/0573 148/105 |
| 2014/0247100 | A1 * | 9/2014 | Tsubokura | H01F 1/053 335/302 |

FOREIGN PATENT DOCUMENTS

| | | | |
|---|---|---|---|
| CN | 1261717 | A | 8/2000 |
| CN | 103093912 | A | 5/2013 |
| JP | 59-046008 | A | 3/1984 |
| JP | 2002-190404 | A | 7/2002 |
| JP | 2003328093 | * | 11/2003 |
| JP | 2011-187624 | A | 9/2011 |
| JP | WO2013054842 | * | 4/2013 |

* cited by examiner

*Primary Examiner* — Colleen P Dunn
*Assistant Examiner* — Nicholas A Wang
(74) *Attorney, Agent, or Firm* — Oliff PLC

(57) ABSTRACT

In the present invention, a permanent magnet with excellent temperature properties and magnetic properties which will not significantly deteriorate can be stably prepared, by using a raw alloy for the R-T-B based permanent magnet in which the rare earth element(s) composed of at least one selected from the group consisting of Y, La and Ce is selected as a predetermined amount of the rare earth element R in the R-T-B based permanent magnet and a proper amount of Ca is contained.

6 Claims, No Drawings

R-T-B BASED PERMANENT MAGNET AND RAW ALLOY FOR THE SAME

The present invention relates to an R-T-B based permanent magnet and the raw alloy(s) for the R-T-B based permanent magnet.

BACKGROUND

It is well known that an R-T-B based permanent magnet (wherein R represents a rare earth element, T represents Fe or Fe with part of it substituted by Co) with a tetragonal compound $R_2T_{14}B$ as its main phase has excellent magnetic properties, and is a representative permanent magnet with high performance since it was invented in 1982 (Patent Document 1: JP S59-46008A).

In particular, the R-T-B based permanent magnet in which the rare earth element R consists of Nd, Pr, Dy, Ho or Tb has a large magnetic anisotropy field Ha, and is widely used as the permanent magnet material. Of those, the Nd—Fe—B based magnet with Nd as the rare earth element R is widely used in people's livelihood, industries, transportation equipment and the like, because it has a good balance among saturation magnetization Is, curie temperature Tc and magnetic anisotropy field Ha, and is better in resource volume and corrosion resistance than the R-T-B based permanent magnets with other rare earth elements R. However, there are some problems in the Nd—Fe—B based permanent magnet. In particular, the absolute value of the temperature coefficient of the residual flux density is large, and only a small magnetic flux can be provided especially under a high temperature above 100° C. compared to that under room temperature.

PATENT DOCUMENTS

Patent Document 1: JP-A-59-46008

Patent Document 2: JP-A-2011-187624

Y and the like are well known as a rare earth element that has smaller absolute values of the temperature coefficients of residual flux density and coercivity than those of Nd, Pr, Dy, Ho and Tb. The Patent Document 2 has disclosed a Y-T-B based permanent magnet with Y as the rare earth element R in the R-T-B based permanent magnet. It is said that although the Y-T-B based permanent magnet contains $Y_2Fe_{14}B$ phase with a small magnetic anisotropy field Ha as the main phase, a permanent magnet with a practical coercivity can be provided by increasing the amounts of Y and B to levels higher than those based on the stoichiometric composition of $Y_2Fe_{14}B$. Further, by using Y as the rare earth element R in the R-T-B based permanent magnet, a permanent magnet with smaller absolute values of the temperature coefficients of residual flux density and coercivity than those of the Nd—Fe—B based permanent magnet can be obtained. However, the Y-T-B based permanent magnet disclosed in Patent Document 2 has a residual flux density of about 0.5 T to 0.6 T, a coercivity of about 250 kA/m to 350 kA/m, and the magnetic properties are significantly lower than those of the Nd-T-B based permanent magnet. That is, the Y-T-B based permanent magnet described in Patent Document 2 can hardly replace the conventional Nd-T-B based permanent magnet. In addition, Y is a kind of raw material that can be easily oxidized, however the variation of the magnetic properties has not been described.

SUMMARY

The present invention has been achieved in view of the situation mentioned above. It is an object of the present invention to prepare a permanent magnet with excellent temperature properties and magnetic properties that will not significantly deteriorate even under a high temperature above 100° C., compared to the R-T-B based permanent magnet widely used in people's livelihood, industries, transportation equipment and the like.

To solve the problems mentioned above and to achieve the object of the present invention, a raw alloy for the R-T-B based permanent magnet of the present invention is provided the product of which has a main phase grains with a composition of $(R1_{1-x}R2_x)_2T_{14}B$ (wherein R1 represents at least one rare earth element that does not include Y, La or Ce, R2 represents the rare earth element(s) composed of at least one selected from the group consisting of Y, La and Ce, T represents at least one transition metal element containing Fe or the combination of Fe and Co as essential element(s), and $0.1 \leq x \leq 0.5$), and contains 25 ppm to 300 ppm of Ca in terms of weight ratio. With such a structure, a permanent magnet with excellent temperature properties and magnetic properties that will not significantly deteriorate compared to the conventional R-T-B based permanent magnet can be stably prepared.

Since the rare earth element(s) composed of at least one selected from the group consisting of Y, La and Ce is/are selected for the composition of the main phase grains, the absolute value of the temperature coefficient of the magnetic anisotropy field becomes lower than that of Nd and the like, and a permanent magnet with excellent temperature properties and magnetic properties that will not significantly deteriorate can be prepared.

On the other hand, it is well known that Y, La and Ce have higher reactivity compared to Nd and the like. In this respect, they may react with foreign matters in the storage or the pulverization process, and it is thus hard to stably provide a high coercivity. The activity of the raw alloy will decrease and the reaction with the foreign matters in the storage or the pulverization process can be reduced, by using a raw alloy for the R-T-B based permanent magnet with a proper amount of Ca.

Further, each of Y, La and Ce has a melting point different from that of Nd. Abnormal grain growth is likely to happen in the sintering process when several rare earth elements with different melting points are mixed. A minor phase will exist in the sintering process and the abnormal grain growth can be inhibited by using a raw alloy for the R-T-B based permanent magnet with an appropriate amount of Ca.

In the raw alloy for the R-T-B based permanent magnet of the present invention, the amount of O (oxygen) is preferably 500 ppm to 5000 ppm in terms of weight ratio. A permanent magnet with excellent temperature properties can be further stably prepared by controlling the amount of O within the mentioned range.

The O is generally deemed as an element which makes the magnetic properties deteriorate. However, when a proper amount of O is contained, the effect of inhibiting the abnormal grain growth can be effectively improved.

An R-T-B based permanent magnet characterized in containing 15 ppm to 250 ppm of Ca in terms of weight ratio can be obtained by using the raw alloy for the R-T-B based permanent magnet the product of which has a main phase grains with a composition of $(\mathbf{R1}_{1-x}\mathbf{R2}_x)_2T_{14}B$ (wherein R1 represents at least one rare earth element that docs not include Y, La or Ce, R2 represents the rare earth element(s) composed of at least one selected from the group consisting of Y, La and Cc, T represents at least one transition metal element containing Fe or the combination of Fe and Co as essential element(s), and $0.1 \leq x \leq 0.5$), and contains 25 ppm to 300 ppm of Ca in terms of weight ratio, and sintering it.

Further, an R-T-B based permanent magnet characterized in containing 15 ppm to 250 ppm of Ca in terms of weight ratio and 600 ppm to 6000 ppm of O in terms of weight ratio can be obtained, by using the raw alloy for the R-T-B based permanent magnet in which the amount of O (oxygen) is preferably 500 ppm to 5000ppm in terms of weight ratio, and sintering it.

According to the present invention, a permanent magnet with excellent temperature properties and magnetic properties which will not significantly deteriorate can be stably prepared, by using a raw alloy for the R-T-B based permanent magnet in which the rare earth element(s) composed of at least one selected from the group consisting of Y, La and Ce is selected as a predetermined amount of the rare earth element R in the R-T-B based permanent magnet and a proper amount of Ca is contained.

DETAILED DESCRIPTION OF EMBODIMENTS

The embodiments for carrying out the present invention will be described in detail. However, the present invention is not limited by the following embodiments. In addition, the constituent elements described below may include elements easily assumed by those skilled in the art and elements which are substantially the same. Further, the constituent elements described below can be appropriately combined.

The raw material for the R-T-B based permanent magnet of the present embodiment is characterized in that the product of it has a main phase grains with a composition of $(R1_{1-x}R2_x)_2T_{14}B$ (wherein R1 represents at least one rare earth element that does not include Y, La or Ce, R2 represents the rare earth element(s) composed of at least one selected from the group consisting of Y, La and Ce, T represents at least one transition metal element containing Fe or the combination of Fe and Co as essential element(s), and $0.1 \leq x \leq 0.5$), and it contains 25 ppm to 300 ppm of Ca in terms of weight ratio.

By using a raw alloy for the R-T-B based permanent magnet in which the rare earth element(s) composed of at least one selected from the group consisting of Y, La and Ce is selected as a predetermined amount of the rare earth element R in the R-T-B based permanent magnet and a proper amount of Ca is contained, the amount of foreign matters can be inhibited by reducing the reactions with the foreign matters in the preparation of the magnet, and the diameter distribution in the main phase grains will be improved as the abnormal grain growth is inhibited.

In the raw alloy for the R-T-B based permanent magnet of the present embodiment, the amount of Ca is 25 ppm to 300 ppm in terms of weight ratio. If the amount is less than 25 ppm, the effect of reducing the reaction with foreign matters during the preparation of the magnet and the effect of inhibiting abnormal grain growth will not be sufficiently provided. On the other hand, if the amount exceeds 300 ppm, the ratio of the minor phase will increase and the magnetic properties will deteriorate significantly.

Here, the raw alloy for the R-T-B based permanent magnet of the present embodiment preferably contains 500 ppm to 5000 ppm of O in terms of weight ratio. If the amount of O is controlled to be within the mentioned range, the effect of inhibiting the abnormal grain growth by the minor phase containing Ca and O can be improved, and the diameter distribution of the main phase grains can be improved. If the amount of O is less than 500 ppm, the effect of inhibiting the abnormal grain growth during the preparation of the magnet will not sufficiently be provided. On the other hand, if the amount exceeds 5000 ppm, the ratio of the minor phase will increase and high magnetic properties will not be provided.

The R-T-B based permanent magnet of the present embodiment contains 11 at % to 18 at % of rare earth element(s). If the amount of the rare earth element R is less than 11 at %, the formation of $R_2T_{14}B$ phase contained in the R-T-B based permanent magnet will be insufficient and a soft magnetic α-Fe and the like will precipitate, and the coercivity will decrease significantly. On the other hand, if the amount of R exceeds 18 at %, the volume ratio of $R_2T_{14}B$ phase will decrease and the residual magnetic flux density will decrease.

In the R-T-B based permanent magnet of the present embodiment, the rare earth element(s) may contain impurities derived from raw materials. Further, considering obtaining a magnetic field with high anisotropy, it is preferable that R1 is Nd, Pr, Dy, Ho or Tb. Besides, from the viewpoint of costs of raw materials and corrosion resistance, Nd is more preferable.

In the R-T-B based permanent magnet of the present embodiment, the amount x of R2 in the composition of the main phase grains is in the range of $0.1 \leq x \leq 0.5$. If x is less than 0.1, permanent magnet with excellent temperature properties will not be obtained. This is considered to be due to the small ratios of Y, La and Ce to the rare earth element. If x is larger than 0.5, the residual magnetic flux density Br will significantly deteriorate. This is because that Y, La and Ce will not show larger magnetization in the $R_2T_{14}B$ permanent magnet compared to Nd or the like.

In the R-T-B based permanent magnet of the present embodiment, T is one or more transition metal elements containing Fe or a combination of Fe and Co as essential element(s). The amount of Co is preferred to be 0 at % or more and 10 at % or less relative to that of T. The Curie temperature can be increased by increasing the amount of Co, and thus the decrease of the coercivity relative to the increase of temperature can be suppressed to a small level. In addition, the corrosion resistance of the rare earth based permanent magnet can be improved by increasing the amount of Co.

The R-T-B based permanent magnet according to the present embodiment contains 5 at % to 8 at % of B. In the case that the amount of B is less than 5 at %, a high coercivity can not be obtained. On the other hand, if the amount of B is more than 8 at %, the residual magnetic flux density tends to decrease. Hence, the upper limit of B is set to be 8 at %. Further, part of B may be substituted by C. The substitution amount of C is preferred to be 10 at % or less relative to B.

The R-T-B based permanent magnet of the present embodiment may contain either Al or Cu or both of them in an amount of 0.01 at % to 1.2 at %. By containing either Al or Cu or both of them within such a range, the obtained permanent magnet will have a high coercivity, a high corrosion resistance and improved temperature properties.

The R-T-B based permanent magnet of the present embodiment is allowed to contain other elements. For example, Zr, Ti, Bi, Sn, Ga, Nb, Ta, Si, V, Ag, Ge or other elements can be properly contained.

Rare earth metal or rare earth based alloy, pure iron, ferro-boron or the alloys thereof and the like can be used as the raw alloy for the R-T-B based permanent magnet of the present embodiment. As to Ca, a metal of Ca, a Ca based alloy or the like can be used. Various oxides can be used as O. However, because a part of the raw metals may contain Ca and O, the purity level of the raw metals should be selected and the total amount of Ca and O should be adjusted to be a predetermined value.

Hereinafter, preferable examples of the preparation method for the present invention will be described.

In the preparation of the R-T-B based permanent magnet in the present embodiment, first, raw alloy(s) is prepared with which an R-T-B based magnet having a desired composition can be obtained. The raw alloy(s) can be prepared by the strip casting method or other well known melting methods under vacuum or under an inert atmosphere, preferably Ar atmosphere. In the strip casting method, the molten metal obtained by melting the raw metal(s) under a non-oxidative atmosphere such as Ar atmosphere is sprayed to a surface of a rotating roll. The molten metal quenched by the roll is quenched and solidified into a thin plate or a sheet (a scale-like shape). The quenched and solidified alloy is provided with a uniform structure having a grain size of 1 μm to 50 μm. The method for preparing the raw alloy is not limited to the strip casting method, and the raw alloy can also be obtained by melting methods such as the high frequency induction melting method and the like. Further, in order to prevent the segregation after the melting process, for example, the molten metal may be poured on a water cooled copper plate to be solidified. The alloy obtained by the reduction diffusion method can also be used as the raw alloy.

In the case of obtaining the R-T-B based permanent magnet in the present invention, although the so-called single-alloy method for manufacturing a magnet from one kind of alloy is substantially used, the so-called mixing method can also be applied. In the mixing method, an alloy (low-R alloy) for the main phase which mainly contains $R_2T_{14}B$ crystals as the main phase grains and an alloy (high-R alloy) which contains more R than the low-R alloy and efficiently contributes to the formation of the grain boundary are used.

The raw alloy(s) is subjected to a pulverization process. In the case of using the mixing method, the low-R alloy and the high-R alloy are pulverized respectively or together. The pulverization process includes a coarse pulverization step and a fine pulverization step. First, the raw alloy(s) is coarsely pulverized to an extent that a particle diameter of approximately several hundred μm is obtained. The coarse pulverization is preferably performed using a stamp mill, a jaw crusher, a Brown mill or the like in the atmosphere of an inert gas. Before the coarse pulverization, it is effective to perform pulverization by absorbing hydrogen in the raw alloy, then releasing the hydrogen. The purpose for the hydrogen-releasing treatment is to reduce hydrogen that will be the impurities in the rare earth based sintered magnet. The maintaining heating temperature for hydrogen absorption is set to 200° C. or more, preferably 350° C. or more. The maintaining time depends on its relation with maintaining temperature, the thickness of the raw alloy and the like, however it is set to at least 30 minutes or more, preferably 1 hour or more. The hydrogen-releasing treatment is preformed in vacuum or in the gas flow of Ar. Further, the hydrogen-absorbing treatment and the hydrogen-releasing treatment are not essential process. It is also possible to position the hydrogen pulverization as the coarse pulverization and omit a mechanical coarse pulverization.

After the coarse pulverization, it is subjected to the fine pulverization process. During the fine pulverization, a jet mill is mainly used to pulverize the coarse pulverized powder with a particle diameter of approximately several hundred μm to a powder with an average particle diameter of 2.5 μm to 6 μm, preferably 3 μm to 5 μm. The method using a jet mill is to discharge inert gas with high pressure from a narrow nozzle to produce a high speed gas flow, accelerate the coarse pulverized powder with the high speed gas flow, and cause a collision between coarse pulverized powders or a collision between coarse pulverized powders and a target or a container wall.

The wet pulverization may also be applied in the fine pulverization. In the wet pulverization, a ball mill, a wet attritor or the like can be used to pulverize the coarse pulverized powder with a particle diameter of approximately several hundred μm to a fine powder with an average particle diameter of 1.5 μm to 5 μm, preferably 2 μm to 4.5 μm.

In order to improve the lubricity and the orientation in the molding process, fatty acids or derivatives thereof or hydrocarbons, for example, stearic acid based substance or oleic acid based substance such as zinc stearate, calcium stearate, aluminum stearate, stearic acid amide, oleic acid amide, ethylene bis(isostearic acid amide), paraffin and naphthalene as hydrocarbons, and the like, can be added in an amount of about 0.01 wt % to 0.3 wt % during a fine pulverization process.

The fine pulverized powder is subjected to a molding process in a magnetic field. In the molding process in a magnetic field, the molding pressure may be set to a range of 0.3 ton/cm$^2$ to 3 ton/cm$^2$ (30 MPa to 300 MPa). The molding pressure may be constant or increased gradually or decreased gradually or irregular from the beginning to the end of the molding process. The lower the molding pressure is, the better the orientation is. However, if the molding pressure is too low, the strength of the molded body will be insufficient, which will cause problems in handling. Thus, considering the above respect, the molding pressure is selected within the range mentioned above. The molded body obtained by molding in a magnetic field usually has a final relative density of 40% to 60%.

The applied magnetic field may be around 960 kA/m to 1600 kA/m. The applied magnetic field is not limited to a static magnetic field, and a pulsed magnetic field can also be used. Further, a static magnetic field and a pulsed magnetic field can also be used in combination.

The molded body is subjected to a sintering process. The sintering process is performed in a vacuum or an inert gas atmosphere. It is necessary to adjust the sintering temperature and the maintaining time for sintering according to many conditions, such as the composition, the pulverization method, the difference between the average particle diameter and the particle size distribution, and the like. However, the sintering process may be performed at a temperature of about 1000° C. to 1200° C. for 2 hours to 20 hours.

After the sintering process, the obtained sintered body may be subjected to an aging treatment. The process of aging treatment is effective to adjust the coercivity, but it is difficult to decrease the variation of coercivity only by the aging treatment process.

EXAMPLES

Hereinafter, the present invention will be described in detail based on examples and comparative examples. However, the present invention is not limited to the examples described below.

Predetermined amounts of metals of the rare earth elements, electrolytic iron, ferro-boron and additive elements were weighed, and an R-T-B alloy in a shape of thin plate was produced by a strip casting method, so that the composition of the main phase grains became $(R1_{1-x}R2_x)_2T_{14}B$ and predetermined Ca and O were added. After the alloy was pulverized to a coarse pulverized powder by heat treating with stirring in a gas flow of hydrogen, oleic acid amide was added as a lubricant and a fine powder (with an average particle diameter of 3 μm) was produced by using a jet mill in a non-oxidative atmosphere. The obtained fine powder was filled into a mold (with an opening size of 20 mm×18 mm), and subjected to uniaxial pressing molding with a pressure of 2.0 ton/cm$^2$ under a magnetic field (2T) applied in a direction perpendicular to the pressing direction. The obtained molded body was heated to 1090° C. and was kept for 4 hours, and then it was cooled down to room temperature. Next, aging treatments at 850° C. for 1 hour and at 530° C. for 1 hour were performed to obtain the sintered body.

Here, Fe was selected as T. The preparations were performed with various combinations of the species and amounts of R1, R2 and amounts of Ca and O shown in Table 1. Here, in the case that a plurality of elements as R2 was contained, the value of each element of R2 represented the ratio within R2. In addition, the analytic results of the amounts of Ca and O in the prepared sintered body were also shown.

TABLE 1

| | Species of R1 | Species of R2 | x | Raw alloy Amount of Ca (ppm) | Raw alloy Amount of O (ppm) | Sintered body Amount of Ca (ppm) | Sintered body Amount of O (ppm) |
|---|---|---|---|---|---|---|---|
| Example 1 | Nd | Y | 0.25 | 150 | 1500 | 127 | 2005 |
| Example 2 | Nd | Ce | 0.25 | 150 | 1500 | 125 | 2010 |
| Example 3 | Nd | La | 0.25 | 150 | 1500 | 128 | 2008 |
| Example 4 | Nd | Y0.5Ce0.25La0.25 | 0.25 | 150 | 1500 | 130 | 2009 |
| Example 5 | Nd | Y0.5Ce0.25La0.25 | 0.50 | 150 | 1500 | 130 | 2015 |
| Example 6 | Nd | Y0.5Ce0.25La0.25 | 0.10 | 150 | 1500 | 124 | 2003 |
| Example 7 | Nd | Y0.5Ce0.25La0.25 | 0.25 | 280 | 1500 | 243 | 2005 |
| Example 8 | Nd | Y0.5Ce0.25La0.25 | 0.25 | 30 | 1500 | 22 | 2021 |
| Example 9 | Nd | Y0.5Ce0.25La0.25 | 0.25 | 150 | 5500 | 130 | 6190 |
| Example 10 | Nd | Y0.5Ce0.25La0.25 | 0.25 | 150 | 25 | 124 | 519 |
| Example 11 | Nd | Y0.5Ce0.25La0.25 | 0.25 | 150 | 3000 | 133 | 3554 |
| Example 12 | Nd | Y0.25Ce0.5La0.25 | 0.25 | 150 | 1500 | 131 | 2015 |
| Example 13 | Nd | Y0.25Ce0.25La0.5 | 0.25 | 150 | 1500 | 129 | 2008 |
| Example 14 | Pr | Y0.5Ce0.25La0.25 | 0.25 | 150 | 1500 | 127 | 2010 |
| Comparative Example 1 | Nd | — | 0.00 | 150 | 1500 | 121 | 2003 |
| Comparative Example 2 | Nd | Pr | 0.25 | 150 | 1500 | 122 | 2010 |
| Comparative Example 3 | Nd | Y0.5Ce0.25La0.25 | 0.55 | 150 | 1500 | 129 | 2020 |
| Comparative Example 4 | Nd | Y0.5Ce0.25La0.25 | 0.05 | 150 | 1500 | 123 | 2001 |
| Comparative Example 5 | Nd | Y0.5Ce0.25La0.25 | 0.25 | 400 | 1500 | 354 | 2004 |
| Comparative Example 8 | Nd | Y0.5Ce0.25La0.25 | 0.25 | 10 | 1500 | 5 | 2210 |

It could be seen from Table 1 that when a raw alloy for the R-T-B based permanent magnet within the ranges defined in claim 3 and claim 4 was used in the preparation, an R-T-B based permanent magnet would be obtained with amounts of Ca and O within the ranges defined in claim 1 and claim 2.

The magnetic properties of the prepared sintered body at a temperature of 100° C. were measured by using a BH tracer. One hundred samples for each of the combination were prepared, and the residual magnetic flux density and the coercivity were determined from the averages of these 100 samples. In addition, the distribution of coercivity was defined as (the maximum value−the minimum value)/(the maximum value+the minimum value)×100 and calculated. The results were shown in Table 2.

TABLE 2

| | Temperature in measurement (° C.) | Residual magnetic flux density Br (mT) | coercivity HcJ (kA/m) | Distribution (%) |
|---|---|---|---|---|
| Example 1 | 100 | 1251 | 637 | 11 |
| Example 2 | 100 | 1245 | 640 | 11 |
| Example 3 | 100 | 1250 | 635 | 11 |
| Example 4 | 100 | 1247 | 640 | 11 |
| Example 5 | 100 | 1195 | 670 | 11 |
| Example 6 | 100 | 1299 | 603 | 11 |
| Example 7 | 100 | 1233 | 668 | 11 |
| Example 8 | 100 | 1248 | 606 | 12 |
| Example 9 | 100 | 1160 | 635 | 13 |
| Example 10 | 100 | 1190 | 601 | 14 |
| Example 11 | 100 | 1240 | 640 | 11 |
| Example 12 | 100 | 1245 | 638 | 11 |
| Example 13 | 100 | 1248 | 639 | 11 |
| Example 14 | 100 | 1240 | 642 | 11 |
| Comparative Example 1 | 100 | 1310 | 477 | 15 |
| Comparative Example 2 | 100 | 1268 | 482 | 16 |

TABLE 2-continued

| | Temperature in measurement (° C.) | Residual magnetic flux density Br (mT) | coercivity HcJ (kA/m) | Distribution (%) |
|---|---|---|---|---|
| Comparative Example 3 | 100 | 901 | 560 | 19 |
| Comparative Example 4 | 100 | 1240 | 463 | 16 |
| Comparative Example 5 | 100 | 1170 | 487 | 16 |
| Comparative Example 6 | 100 | 1148 | 477 | 22 |

It could be clearly seen from the Examples and Comparative Examples that, when the composition fell within the range defined in claim 1, a permanent magnet with excellent temperature properties could be stably prepared. Further, when the composition fell within the ranges defined in claim 1 and claim 2, a permanent magnet with particularly excellent temperature properties could be stably prepared.

What is claimed is:

1. An R-T-B based permanent magnet comprising a main phase grain with a composition of $(R1_{1-x}R2_x)_2T_{14}B$, and further comprising 15 ppm to 250 ppm of Ca in terms of weight ratio, wherein R1 represents at least one rare earth element that does not include Y, La or Ce, R2 represents rare earth element(s) composed of at least one selected from the group consisting of Y, La and Ce, T represents at least one transition metal element containing Fe or the combination of Fe and Co, and $0.1 \leq x \leq 0.5$.

2. The R-T-B based permanent magnet according to claim 1, wherein O is contained in an amount of 600 ppm to 6000 ppm in terms of weight ratio.

3. The R-T-B based permanent magnet according to claim 1, wherein the Ca is present in an amount of 22 ppm to 243 ppm in terms of weight ratio.

4. A raw alloy for an R-T-B based permanent magnet comprising 25 ppm to 300 ppm of Ca in terms of weight ratio, from which a product with main phase grains with a composition of $(R1_{1-x}R2_x)_2T_{14}B$ is obtained, wherein R1 represents at least one rare earth element that does not include Y, La or Ce, R2 represents rare earth element(s) composed of at least one selected from the group consisting of Y, La and Ce, T represents at least one transition metal element containing Fe or the combination of Fe and Co, and $0.1 \leq x \leq 0.5$.

5. The raw alloy for an R-T-B based permanent magnet according to claim 4, wherein O is contained in an amount of 500 ppm to 5000 ppm in terms of weight ratio.

6. The raw alloy for an R-T-B based permanent magnet according to claim 4, wherein the Ca is present in an amount of 30 ppm to 280 ppm in terms of weight ratio.

* * * * *